US011772103B2

(12) United States Patent
Daryani et al.

(10) Patent No.: US 11,772,103 B2
(45) Date of Patent: Oct. 3, 2023

(54) FILTER-LESS INTELLIGENT AIR PURIFICATION DEVICE

(71) Applicant: Praan Inc., San Francisco, CA (US)

(72) Inventors: Angad Daryani, Mumbai (IN); Arjun Sabnis, Mumbai (IN); Prithvi Rathaur, North Brunswick, NJ (US); Amira Tobasi, Hudson, WI (US); Patrick Finley, Atlanta, GA (US)

(73) Assignee: Praan Inc., San Francisco, CA (US)

( * ) Notice: Subject to any disclaimer, the term of this patent is extended or adjusted under 35 U.S.C. 154(b) by 410 days.

(21) Appl. No.: 16/833,205

(22) Filed: Mar. 27, 2020

(65) Prior Publication Data

US 2021/0299678 A1 Sep. 30, 2021

(51) Int. Cl.

| | |
|---|---|
| ***B03C 3/145*** | (2006.01) |
| ***B03C 3/38*** | (2006.01) |
| ***B03C 3/41*** | (2006.01) |

(52) U.S. Cl.

CPC ..... *B03C 3/145* (2013.01); *B03C 3/38* (2013.01); *B03C 3/41* (2013.01); *B03C 2201/06* (2013.01)

(58) Field of Classification Search

CPC ..... B03C 3/41; B03C 3/019; B03C 3/368; B03C 3/47; B03C 3/011; B03C 3/60; B03C 3/743; B03C 3/76; B03C 2201/08; B03C 2201/10; B03C 2201/32; B03C 3/145; B03C 3/38; B03C 2201/06; B03C 3/68;

(Continued)

(56) References Cited

U.S. PATENT DOCUMENTS 4,203,704 A * 5/1980 Saint-Amand ..... H02K 7/14 417/353
4,214,879 A * 7/1980 Whetstone ..... E21B 21/067 96/196

(Continued)

FOREIGN PATENT DOCUMENTS

CN 1721046 A 1/2006
WO WO-2019193433 A1 * 10/2019 ..... A61L 9/20

OTHER PUBLICATIONS

Angag Daryani, Zeena Saif, Daryal Brown and Tom Page, Angad Daryani wants to scrub pollution from the air, video posted on cnn.com, posted on Mar. 28, 2018, site visited on Dec. 23, 2022, online, available from internet https://edition.cnn.com/2018/03/28/health/angad-daryani-tomorrows-hero/index.html.

(Continued)

*Primary Examiner* — Frank M Lawrence, Jr.
*Assistant Examiner* — Sonji Turner
(74) *Attorney, Agent, or Firm* — Brett A. Schenck

(57) ABSTRACT

An air purification system for purifying atmospheric air has an ionization chamber that includes a needle arrangement. The needles create a dense and strong electric field when a high voltage is passed to them by the effect of dual charge ionization due to which the suspended particles in the polluted air get clumped together and fall. The second invention is an air monitoring system facilitating a two-way communication with external information sources. It contains gas sensors comprising of an ambient noise sensor, temperature and humidity sensor, and sensors to measure the amount of oxides of nitrogen, Sulphur, carbon and size of suspended particles in the air. The third invention is a theft protection module for the safe keeping of an air purification system.

19 Claims, 18 Drawing Sheets

(58) Field of Classification Search
CPC ..... B03C 2201/28; B03C 3/12; B03C 3/49; B03C 3/361; B03C 3/0175; A61L 9/22; A61L 2209/14; A61L 9/20; B01D 2257/302; B01D 2257/304; B01D 2257/404; B01D 2257/90; B01D 2258/06; B01D 2259/818; B01D 53/323; B01D 2273/30; B01D 46/0028; B01D 46/0032; B01D 46/0038; B01D 2201/54; F24F 2221/44
See application file for complete search history.

(56) References Cited

U.S. PATENT DOCUMENTS 4,336,749 A * 6/1982 Barnhart ..... F24F 13/20 248/58
4,670,026 A * 6/1987 Hoenig ..... B03C 3/455 96/97
4,718,923 A * 1/1988 Haag ..... F01N 3/01 96/56
4,734,105 A * 3/1988 Eliasson ..... B03C 3/49 96/57
4,765,803 A * 8/1988 Hirth ..... B03C 3/38 95/80
5,824,137 A * 10/1998 Gutsch ..... B03C 3/0175 96/97
6,004,375 A * 12/1999 Gutsch ..... B03C 3/0175 96/97
6,228,148 B1 * 5/2001 Aaltonen ..... B01D 53/323 96/228
6,830,440 B1 * 12/2004 Riddoch ..... H02K 29/08 417/353
6,872,238 B1 * 3/2005 Truce ..... B03C 3/12 96/87
7,114,388 B1 10/2006 French et al.
7,582,144 B2 * 9/2009 Krigmont ..... B03C 3/025 96/99
7,806,952 B2 * 10/2010 Fox ..... A61L 9/22 313/313
7,964,021 B2 * 6/2011 Younsi ..... B03C 3/368 96/61
8,518,163 B2 * 8/2013 Lemont ..... B03C 3/49 96/88
8,564,924 B1 10/2013 Waddell et al.
8,747,527 B2 * 6/2014 Maus ..... F01N 3/01 60/275
9,097,155 B2 * 8/2015 Hodgson ..... B03C 3/49
9,145,110 B2 * 9/2015 Van Wiemeersch ..... B60R 25/1004
9,493,085 B2 * 11/2016 Van Wiemeersch .... H02J 50/60
9,702,315 B1 * 7/2017 Palmer ..... G07C 5/008
10,744,515 B2 * 8/2020 Vossoughi Khazaei ..... B03C 3/368
2008/0241004 A1 * 10/2008 Jayne ..... F01N 3/0892 422/173
2010/0307332 A1 12/2010 Yuen
2014/0178253 A1 * 6/2014 Van Wiemeersch ..... F01N 3/08 422/119
2014/0266654 A1 * 9/2014 Parker ..... B60R 25/00 340/426.25
2017/0106218 A1 * 4/2017 Lin ..... B03C 3/155
2021/0039112 A1 * 2/2021 Naik ..... B03C 3/011

OTHER PUBLICATIONS

Angag Daryani, Zeena Saif, Daryal Brown and Tom Page, Teen serial inventor returns with pollution filter to clear city skies, article posted on cnn.com, posted on Mar. 28, 2018, site visited on Dec. 23, 2022, online, available from internet https://edition.cnn.com/2018/03/28/health/angad-daryani-tomorrows-hero/index.html.
Proprietary Climate and Environmental Data for Climate Action, Emissions Tracking, and Risk Assessment, site visited on Dec. 23, 2022, Available from the internet, <URL: https://www.getambee.com/.
Get an In-Depth View of the Environment Around You, site visited on Dec. 23, 2022, Available from the internet, <URL: https://www.getambee.com/products/environment-and-climate-monitoring-system.

* cited by examiner

FILTER-LESS INTELLIGENT AIR PURIFICATION DEVICE

BACKGROUND

Technical Field

Embodiments of this disclosure generally relate to an air purification system, a purification method and an air monitoring system, more particularly, to a large scale, filter-less outdoor air purification device that purifies the air by collecting the particle matter using bi-polar ionization process. The second system makes use of two-way communication to regulate air cleaning devices. The third invention is a theft protection module for the safekeeping of an air purification system.

Description of the Related Art

Particle pollution, also known as particulate matter or PM, is a general term for a mixture of solid and liquid droplets suspended in the air. Particle pollution comes in many sizes and shapes and can be made up of a number of different components, including acids, inorganic compounds, organic chemicals, soot, metals, soil or dust particles, and biological materials. Human health degrades today due to inhalation of such polluted air. Air quality in major cities across the globe is taking a toll to alarming levels due to large scale industrialization without respecting emission norms. Airborne pollutants can also contribute to respiratory infections and illnesses which can be hazardous to individuals with respiratory problems. Particles in the air may create problems with burning eyes, act as nose and throat irritations, contribute to headaches and dizziness and can result in coughing and sneezing. Furthermore, these particles may include various types of spores, bacteria, viruses or harmful particles which may cause serious illness to a person. Inhaling polluted air aggravates respiratory diseases such as emphysema, bronchitis and asthma, etc. and can cause several other lung diseases.

The main challenge that pertains to this invention is the purification of air for breathing and, in particular, the process to remove dust, harmful particles and noxious gases from atmospheric air found indoors and outdoors. Over the years, many types of air purifiers and equipment have been provided to purify and dedust air. Traditional air purifiers had filter screens which required periodic replacement and maintenance in order to prevent it from getting clogged.

In the past few decades, there have been multiple technologies using point ionizers. An ionizer is a device which emits electrically charged ions which clean impurities from the air and provide a feeling of well-being to the user. In this section, details of these point ionizers have been discussed along with their challenges.

The first is the Electro-Static Precipitator which works on a two-step procedure. As mentioned in patent US20100307332, the polluted air passes through an ionizing mechanism and the particles get charged. Then the charged particles pass through the next section of the air purifier which holds plates that have the charge opposite to the charge just given to the particles. These particles then stick to these plates and the clean air comes out from the air purifier. These plates must be cleaned periodically or will cease to capture the particles. Electrostatic precipitators have a high initial capital cost, which makes it prohibitive for small-scale industries. They are expensive to purchase and install. In addition to being costly, they require large amount of space to be set up. Also, an electrostatic precipitator can be used for collecting only dry and wet pollutants in the solid form and not for gaseous pollutants. Electrostatic precipitators also generate large amounts of electromagnetic noise/disturbances.

The second technology is a Single Ion Generator which is illustrated in U.S. Pat. No. 8,564,924B1. In single ion generator air purifiers, negatively charged ions are produced with the help of a plurality point ionizers (carbon brush or stainless-steel needle) which then stick to particulates of dust and noxious gases. These negatively charged particles are then collected on a particulate collection surface. A major drawback of this system is the excessive generation of Ozone gas, a chemical variant of oxygen in air that is a toxic air pollutant.

The third technology is Photo-Catalytic oxidation air purifier. In the patent CN1721046A, the catalyst that cleans the air is typically titanium dioxide and it is energized by ultraviolet (UV) light. Titanium dioxide is a semiconductor which is used in the form of a thin film covering the surface of a backing material called a substrate, which is usually made from a ceramic or a piece of metal (such as aluminum). Titanium dioxide catalyst breaks apart molecules of air pollution in an air purifier. The disadvantage of this process is that photocatalytic purifiers produce hydroxyl radicals and tiny amounts of ozone (03). Hydroxyl radicals other than Ozone can pose dangers to human health.

It is, therefore, desirable to provide an improved air purification system and process which overcomes most, if not all, of the preceding problems.

The second challenge in the context of the invention pertains to the monitoring of the quality of the breathable air and controlling the operation of air purification system using this information using intelligent feedback. There are numerous technologies which monitor indoor and outdoor air quality. However, we are not aware of any system that communicates with paired devices for altering their operational model. A desirable system should send signals to the paired air purifiers for movement of its parts in order to adapt itself to the forecasted weather or for self-regulation. In the following section, details of current systems for outdoor air monitoring are described.

The first technology is an outdoor air monitoring system such as the one offered in the market by Ambee India (https://getambee.com/). It is a high-resolution monitoring and hazard mitigation solutioning product which has numerous gas, temperature, pressure, humidity and particle size sensors. However, this product when connected with an air purifier doesn't communicate any signals to it for its better operational efficiency. Moreover, it doesn't make use of its technology for the purpose of self-regulation. It is also susceptible to theft given the lack of a protection system.

The second technology as mentioned in the U.S. Pat. No. 7,114,388B1 is a geographically distributed environmental sensor system. It is a sensor network that includes a number of sensor units and a base unit. The base station operates in a network discovery mode (in which network topology information is collected) in a data polling mode (in which sensed information is collected from selected sensory units). Each of the sensor units can include a number of features, including an anemometer, a rain gauge, a compass, a GPS receiver, a barometric pressure sensor, an air temperature sensor, a humidity sensor, a level, and a radiant temperature sensor. This technology only monitors the present state of weather and does not make use of the prediction algorithms. This leads to a delay in change of operating model. This system is designed using a cluster model in order to save costs in networking. However, when such a system is implemented, the base station for any cluster determines the ability of all the devices in that cluster to upload their data to cloud. If the base station fails, all the devices in that cluster fail. Hence building a decentralized and individual transmission model is essential.

The third challenge in the context of the invention pertains to the safe keeping of outdoor air purification systems. In many parts of the world, especially in developing nations, where street crimes are quite prevalent, outdoor systems can be easily stolen and thus there is a need to solve this problem.

It is, therefore, desirable to provide an air purification system that addresses the disadvantages of the current systems while improving the operational performance, maintenance and safe keeping of the system using the monitoring of predicted weather conditions, air quality and current performance of the system and providing the required feedback.

SUMMARY

In view of the foregoing, an embodiment herein provides an air purification system. The air purification system includes an inlet unit, at least one ionization chamber, a collection unit and an output unit. The inlet unit includes at least one inlet unit inlet that draws polluted air. The inlet unit includes a first end and a second end. The ionization chamber includes a plurality of point ionizers operable to produce positively and negatively charged ions for cleaning the polluted air drawn through the inlet. The ionization chamber includes a proximal end and a distal end. The proximal end of the ionization chamber is communicatively coupled to the second end of the inlet unit and the distal end is connected to at least one collection chamber. When a voltage is applied to the ionization chamber, the plurality of point ionizers produces the positively and negatively charged ions that capture particulate matter from the polluted air and fuse the positively and negatively charged particles together to form clumped particles. The clumped particles are expelled into the collection chamber. The collection unit includes at least one collection chamber that collects the clumped particles. The output unit includes at least one outlet that expels the cleaned air. The collection chamber includes an inlet and an outlet. The inlet of the collection chamber is connected to the distal end of the ionization chamber for collecting the clumped particles. One end of the outlet unit is connected to the outlet of the collection chamber.

In some embodiments, the inlet unit includes an opening, a cover plate and a fan holder. The opening is between the cover plate and the fan holder. The fan holder includes at least a fan that is rotated at required speed to pull air into the system, an attachment to reduce inlet air speed and a mesh to restrict entry of particulate matter. The fan is located at the front end of the fan holder. The cover plate is designed to prevent entry of foreign particles.

In some embodiments, the collection chamber stores the particulate matter from the ionized air. The outlet expels of the cleaned air from the air purification system.

In some embodiments, the air purification system is communicatively connected to a theft protection module for providing protection to the air purification system. The theft protection module includes a power module, a microcontroller, a location module, an analog/a digital data receiver/transmitter system and a network module. The power module supplies electrical power to the microcontroller. The location module measures a physical location of the air purification system. The network module transmits and receives information from a cloud server. The microcontroller is connected to the location module and the network module via at least one of the analog/the digital data receiver/transmitter system.

In some embodiments, the air purification system is communicatively connected to an air quality and environmental monitoring system. The air quality and environmental monitoring system includes a sensor array and the microcontroller. The sensor array includes at least one of a gas sensor, a particulate matter (PM) sensor, an ambient noise sensor or a temperature and humidity sensor. The gas sensor measures a level of Oxides of Nitrogen, Oxides of Sulphur, Oxides of Carbon and Ozone present in the polluted air. The particulate matter (PM) sensor measures a size, in a range of 1.0 to 10 micrometers, of the particle present in the polluted air. The ambient noise sensor measures an amplitude, frequency of a noise associated with the polluted air. The temperature and humidity sensor measures temperature and humidity of the polluted air. The microcontroller is communicatively connected to the sensor array. The microcontroller receives sensor information from the sensor array using a digital or analog signal receiver, and process the sensor information to control a speed of the fan or a state of the air purification system and at least one actuator on the outlet or inlet of the air purification system.

In some embodiments, the air quality and environmental monitoring system allows dynamic information flow between the sensor array to optimally use the air purification system. The air quality and environmental monitoring system includes the power module and the network module. The power module is controlled by the microcontroller. The network module is connected to the micro-controller via a digital or analog data receiver or a transmitter system.

In some embodiments, the second power module includes a DC power supply and a battery module. The DC power supply is connected to the battery module. The battery module includes a charge controller and a lithium ion battery. The charge controller reads a battery level from the lithium ion battery.

In some embodiments, the micro-controller receives analog input, digital input, ADC/DAC and is connected to the sensor array and the power module.

In some embodiments, the gas sensor includes sensors to measure levels of Oxides of Sulphur. Oxides of Nitrogen, Oxides of Carbon, and Ozone, and the particulate matter sensor includes PM1.0, PM2.5 and PM10 sensors.

In some embodiments, the network module contains a wired or a wireless module, and the wireless module is capable of local and wide area communications.

In some embodiments, the dynamic information flow includes information flow between the sensor array, the micro-controller, the network module, the power supply, the fan of the air purification system, the actuator on the outlet or inlet of the air purification system, an automatic maintenance scheduling system, API's, online third party API's and an online database. The sensor array sends information to the microcontroller. The micro-controller communicates with the cloud server through the network module. The cloud server sends information to the API's and the automatic maintenance scheduling system and stores information in the online database. The API's receive information from the online database. The online third party API's send information to the online database. The cloud server receives information from the online third party API's and communicates with the network module to send information to the microcontroller. The micro-controller regulates (i) the amplitude of a DC power supply from a battery of the air purification system, (ii) the speed or state of the fan of the air purification system, and (iii) the actuator on the outlet or inlet of the air purification system.

In some embodiments, the theft protection module includes a protection enclosure that is composed of hydrophobic material.

In some embodiments, the theft protection module is enabled when a DC power supply of the power module is switched off. The power module includes a battery that supplies power to the microcontroller, a charge controller that sends information on change in battery level as a data input to the micro-controller. The micro-controller sends information on a new location measured by the location module to the cloud server. The cloud server compares the new location with a default location set by an installer or end-user.

In some embodiments, the theft protection module is enabled when a current location is measured by the location module. The location module sends the current location to the micro-controller and the micro-controller sends information on the current location to the cloud server. The cloud server compares the new location with the default location set by the installer or end-user.

In another aspect, an ionization chamber within an air purification system includes an inlet unit, an output unit, an electrical power supply and at least one ionization core. The inlet unit including at least one inlet that receives polluted air to be cleaned. The output unit includes at least one outlet to expel cleaned air. The electrical power supply provides a pulsed DC voltage to the ionization chamber. The at least one ionization core have a plurality of point ionizers that is supplied with the pulsed DC voltage provided by the electrical power supply. The plurality of point ionizers is arranged on an inner surface or an outer surface or both surfaces of the ionization chamber to form a plurality of modular assembly. When the pulsed DC voltage is applied to the plurality of point ionizers, at least two of the point ionizers are producing positively and negatively charged ions that capture particulate matter of the polluted air and fuse them together to form clumped particles. The plurality of point ionizers is positioned at the required angles such that the tips of any two point ionizers have a distance of at least 0.5 cm In some embodiments, the ionization core is shaped in the form of a cylinder, frustum, prism, pyramid, sphere, or S with a length based on the plurality of point ionizers.

In some embodiments, each modular assembly is shaped in the form of a cylinder, frustum, prism, pyramid, sphere, or S with a length based on the plurality of point ionizers.

In some embodiments, the electrical power supply operates at greater than 1 Kilo Volts and is harnessed by a thermal, a chemical, a nuclear, an electrical, a radiant, a light, a motion, a sound, an elastic and a gravitational method.

In some embodiments, an inlet 193 (FIG. 4B) of the ionization chamber is at a first modular assembly and an outlet 195 (FIG. 4B) of the ionization chamber is at an end of a Nth modular assembly.

In yet another aspects, a method for treatment of airflow within an air purification system includes steps of: (i) receiving polluted air for cleaning through one or more inlet, (ii) passing polluted air through one or more ionization chamber including of a plurality of point ionizers operable to produce positively and negatively charged ions when a voltage is applied across the plurality of point ionizers, (iii) producing positively and negatively charged particles by attaching the positively and negatively charged ions to the particles in the polluted air, (iv) fusing the positively and negatively charged particles together, (v) accumulating fused particles inside a collection chamber and (vi) releasing clean air through one or more outlet.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1:
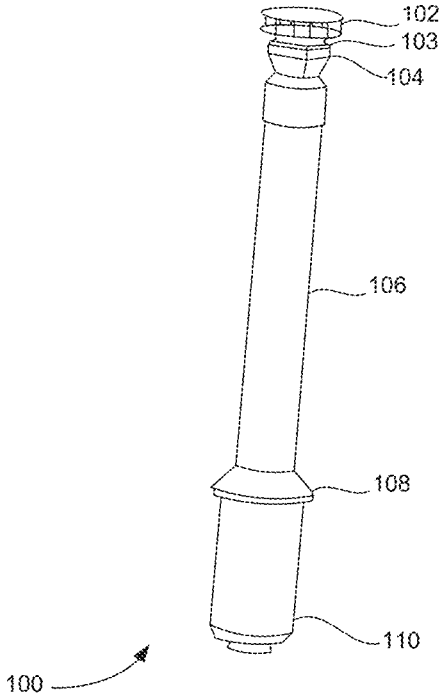
FIG. 1 illustrates a perspective view of an air purification system to purify the air using an ionization process according to the embodiment herein.

The embodiments herein, the various features and advantageous details thereof are explained with reference to the embodiments that are illustrated in the accompanying drawings and detailed in the following description. Descriptions of components and processing techniques that are familiar to persons having ordinary skill in the art are omitted so as to not unnecessarily obscure the embodiments herein. The examples used herein are intended merely to facilitate an understanding of the ways in which the embodiments herein may be practiced and to further enable those of skilled in the art to enable the embodiments herein. Accordingly, the examples should not be construed as limiting the scope of the embodiments herein.

As mentioned, there remains a need for an air purification device to remove the particle matter without using any expensive components and maintenance intensive filters to provide an ozone-free air to the environment. Referring now to the drawings and more particularly to FIG. 1 to FIG. 15, where similar reference characters denote corresponding features consistently throughout the figures.

Figure 16:
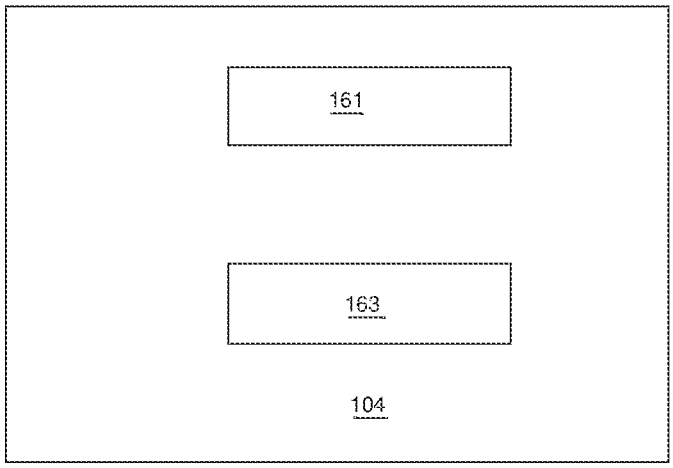
FIG. 16 illustrates a schematic block diagram of the fan holder comprising the fan and the mesh of the air purification system of FIG. 1.

FIG. 1 illustrates a perspective view of an air purification system to purify the air using an ionization process according to the embodiment herein. The air purification system includes an inlet unit 102, an ionization chamber 106, a collection unit 110 and an output unit 108. The air purification system 100 draws in the polluted air from the atmosphere using the inlet unit 102. In some embodiments, the inlet unit 102 includes at least one inlet 111. The inlet unit 102 includes a first end 107 and a second end 109. The ionization chamber 106 includes a plurality of point ionizers that produces positively and negatively charged ions for cleaning the polluted air drawn through the inlet. The ionization chamber 106 includes a proximal end 123 that is communicatively coupled to the second end 109 of the inlet unit 102 and (ii) a distal end 115 that is connected to at least one collection chamber 153. When voltage is applied, the plurality of point ionizers captures particulate matter from the polluted air using the positively and negatively charged ions and fuses the positively and negatively charged particles together to form clumped particles. The plurality of point ionizers is arranged on an inner surface or an outer surface or both surfaces of the ionization chamber to form a plurality of modular assembly. When the pulsed DC voltage is applied to the plurality of point ionizers, at least two of the point ionizers are producing positively and negatively charged ions that capture particulate matter of the polluted air and fuse them together to form clumped particles. The plurality of point ionizers is positioned at the required angles such that the tips of any two point ionizers have a distance of at least 0.5 cm. The collection unit 110 includes the at least one collection chamber to collect the clumped particles. The collection chamber 153 includes (i) an inlet 159 that is connected to the distal end 115 of the ionization chamber 106 for collecting the clumped particles and (ii) an outlet 151. In some embodiments, the collection chamber stores the particulate matter from the ionized air. In some embodiments, the inlet of the ionization chamber is located at a first modular assembly and the outlet of the ionization chamber is located at an end of a Nth modular assembly. The output unit 108 includes at least one outlet 157 that expels the cleaned air. In some embodiments, one end of the output unit is connected to the outlet of the collection chamber. In some embodiments, the inlet of the inlet unit 102 includes an opening, a cover plate 103 and a fan holder 104. The opening of the inlet is located between the cover plate 103 and the fan holder 104. The fan holder 104 includes at least one fan 161 (FIG. 16) for pulling the polluted air into the air purification system 100 and a duct attachment 105 (FIG. 3) that has a cross-sectional area that expands going at least a partial distance downstream along the duct attachment 105 that reduces inlet air speed and a mesh 163 (FIG. 16) to restrict entry of particulate matter. The fan is located at a front end of the fan holder 104. The cover plate 103 prevents the entry of the foreign particles.

Figure 12:
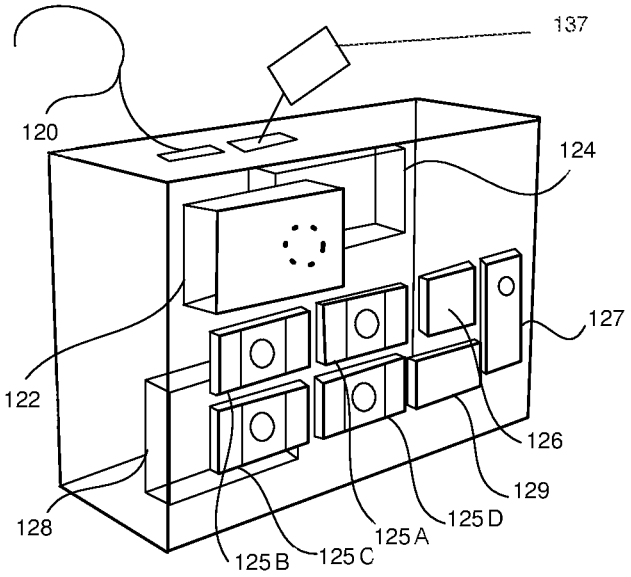
FIGS. 12 and 13 illustrate perspective views of standalone air quality and environmental monitoring system according to the embodiment herein.
Figure 13:
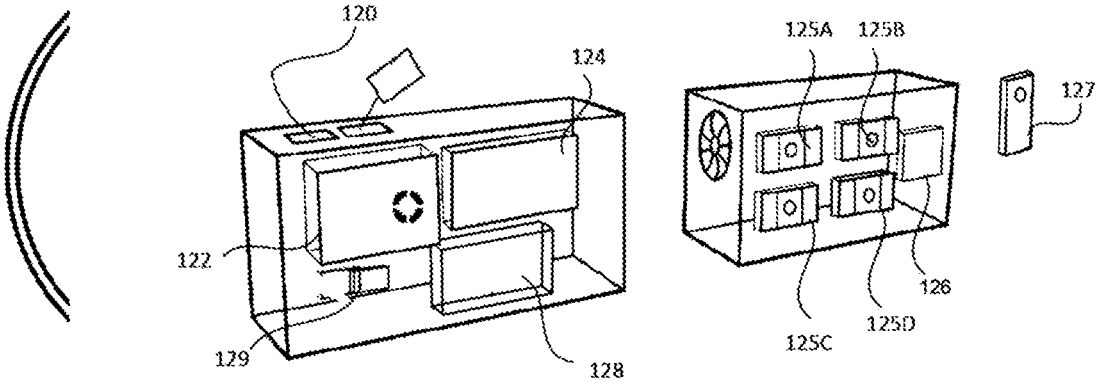
Figure 14:
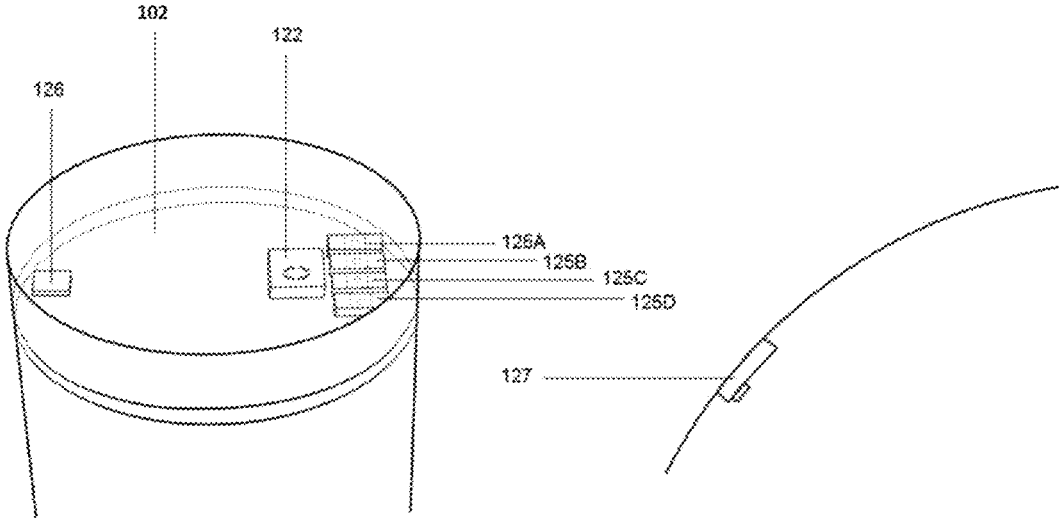
FIGS. 14 and 15 illustrate perspective views of an air purification system along with air quality and environmental monitoring capabilities according to the embodiment herein.
Figure 15:
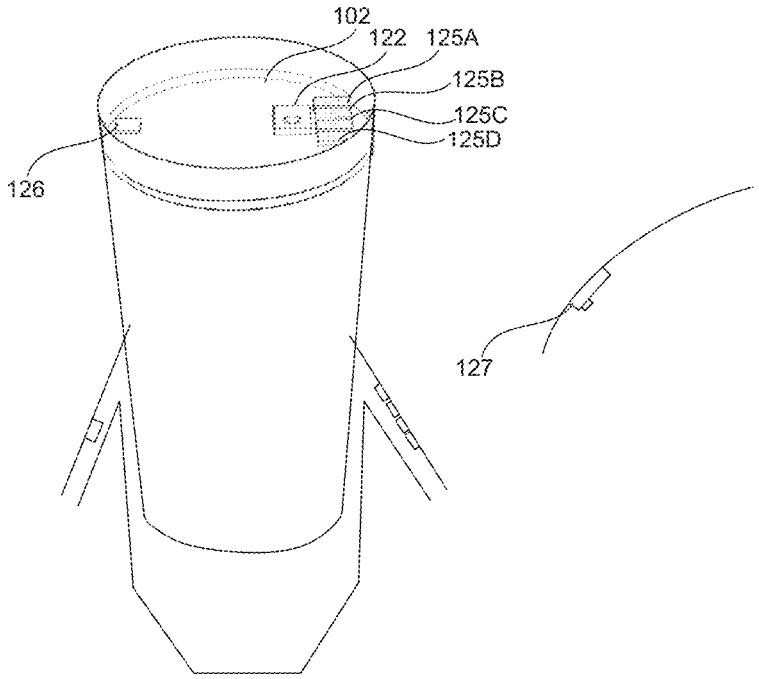
Figure 17:
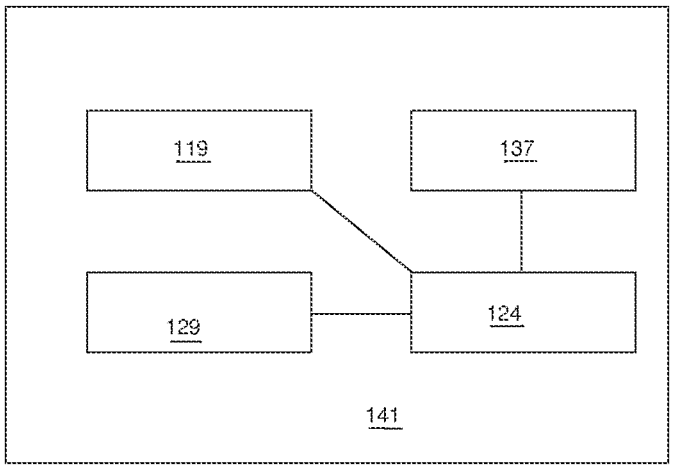
FIG. 17 illustrates a schematic block diagram of the theft protection module comprising the power supply, the network module, the location module, and the micro-controller of the air purification system according to the embodiment herein.

In some embodiments, the air purification system 100 is communicatively connected to a theft protection module 141 (FIG. 17) for protecting the air purification system 100. The theft protection module includes a power module 119, a microcontroller 124, a location module 137, and a network module 129 (FIGS. 12, 13, and 17). In some embodiments, the theft protection module includes a protection enclosure that is composed of hydrophobic material. The power module supplies electrical power to the microcontroller. The theft protection module is enabled when a DC power supply of the power module is switched off. The theft protection module includes a charge controller 173 (FIG. 18) that sends information on change in battery level as a data input to the microcontroller. The microcontroller sends information on a new location measured by the location module to a cloud server 175 to compare the new location with a default location set by an installer or an end user. The location module measures a physical location of the air purification system. The network module transmits and receives information from the cloud server. In some embodiments, the microcontroller is connected to the location module and the network module via at least one of an analog or digital data receiver 171 (FIG. 18) or a transmitter system. In some embodiments, the network module includes a wired module or a wireless module which is capable of local and wide area communications.

Figure 18:
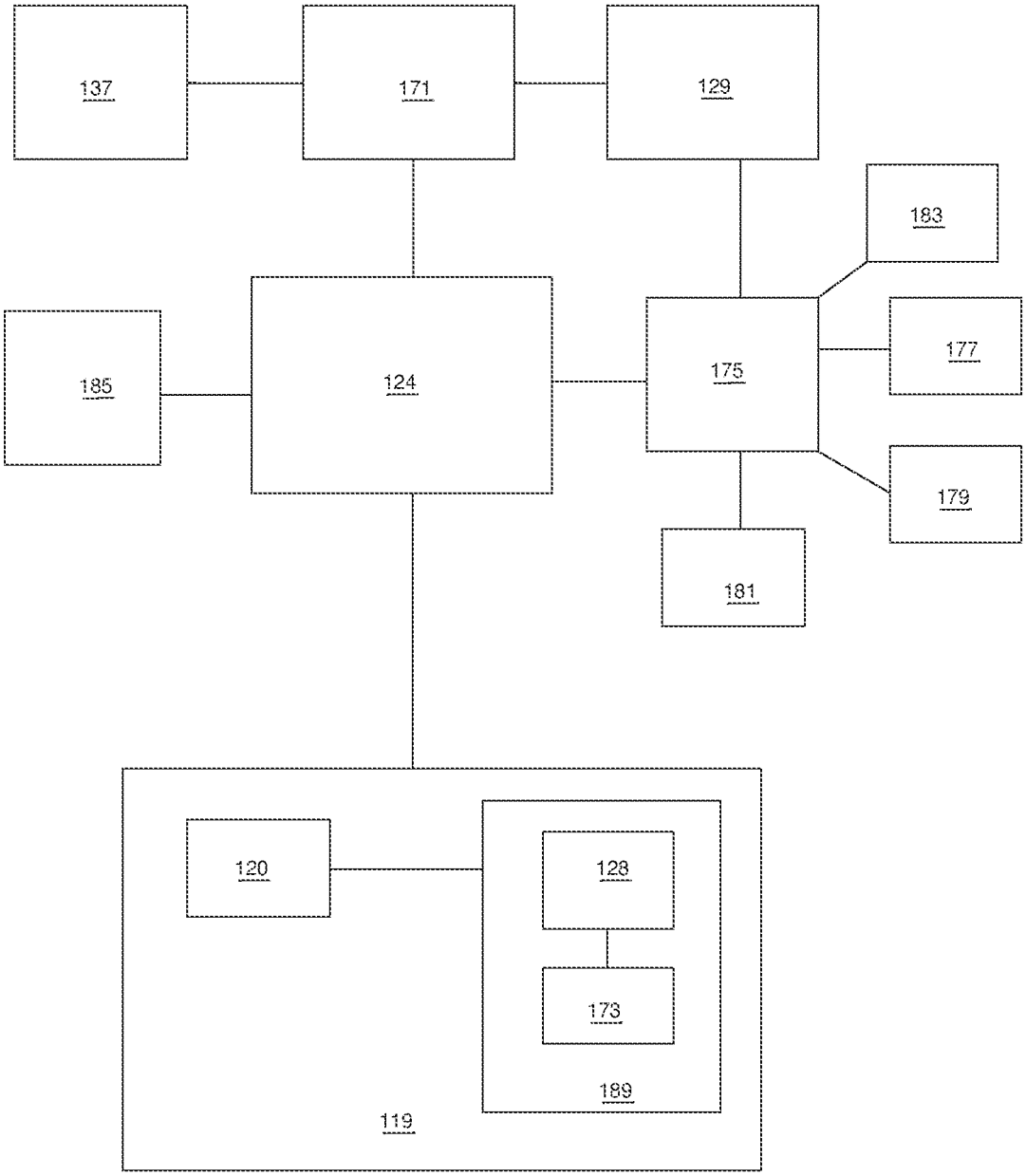
FIG. 18 illustrates a schematic block diagram of several components of the air purification system according to the embodiment herein.

In some embodiments, the air purification system 100 is communicatively connected to an air quality and environmental monitoring system. The air quality and environmental monitoring system includes a sensor array, the power module, the network module and the microcontroller. The micro-controller is communicatively connected to the sensor array to receive sensor information from the sensor array using a digital or analog signal receiver, and process the sensor information to control a speed of the fan or a state of the air purification system and at least one actuator 185 (FIG. 18) on the outlet or inlet of the air purification system 100. The sensor array transmits the sensor information to the micro-controller using the cloud server. The micro-controller regulates (i) the amplitude of a DC power supply from the battery of the air purification system 100, (ii) the speed or state of the fan of the air purification system 100, and (iii) the actuator on the outlet or inlet of the air purification system 100. The micro-controller communicates with the cloud server through the network module to access the sensor information. In some embodiments, the sensor array includes at least one of gas sensors from at least one of Oxides of Sulphur, Oxides of Nitrogen, Oxides of Carbon or Ozone sensors, a particulate matter (PM) sensor from at least one of PM1.0, PM2.5 and PM10 sensors, an ambient noise sensor and a temperature and humidity sensor. In some embodiments, the sensor array measures at least one of a level of Oxides of Nitrogen, Oxides of Sulphur, Oxides of Carbon and Ozone, a size, in a range of 1.0 to 10 micrometers, temperature and humidity, an amplitude or frequency of a noise associated with the polluted air. The air quality and environmental monitoring system allows dynamic information flow between the sensor array to optimally use the air purification system 100. In some embodiments, the dynamic information flow includes information flow between the sensor array, the micro-controller, the network module, the power supply, the fan of the air purification system, the actuator on the outlet or inlet of the air purification system, an automatic maintenance scheduling system 183 (FIG. 18). API's 177 (FIG. 18), online third party API's 179 (FIG. 18) and an online database 181 (FIG. 18).

In some embodiments, the power module 119 is controlled by the micro-controller. The power module includes the DC power supply 120 and a battery module 189 as illustrated in FIG. 18. The DC power supply and the battery module are connected together. The battery module includes the charge controller 173 and the lithium ion battery 128. The charge controller reads a battery level from the lithium ion battery. In some embodiments, the network module is connected to the micro-controller via a digital or analog data receiver or a transmitter system. In some embodiments, the microcontroller is connected to the sensor and the power module to receive analog input, digital input, Analog to Digital Converter or Digital to Analog Converter.

The cloud server (i) transmits the sensor information to the Application Program Interface (API) and the automatic maintenance scheduling system and (ii) stores information in the online database. The API receives the sensor information from the online database. Online third party Application Program Interfaces sends the sensor information to the online databases. The cloud server receives the sensor information from the online third party API's and communicates with the second network module to transmit the sensor information to the micro-controller.

In some embodiments, the polluted air passes to the ionization chamber 106 at a desired velocity fixed by the speed of the fan. In an embodiment, the fan holder 104 may be attached at the rear end of the air inlet unit 102. In some embodiments, the ionization chamber 106 contains a plurality of point ionizers that produce bi-polar ions when a voltage is applied. The produced ionization between the plurality of point ionizers captures the particle matter of polluted air and fuses them together. Fusion is the physical cohesion of particles which causes them to gain weight and lose energy. Due to increased weight, these heavier particles lose their ability to rise up along the purified air which gets forced out from the ionization chamber 106. The clumped particles then fall to the bottom of the ionization chamber 106 and get accumulated in the collection chamber 153. The air purification system 100 pushes the purified air through the output unit 108. In the embodiment, the quality of air is recorded and communicated at each instance. In some embodiments, the electrical power supply to the air purification system 100 operates at greater than 1 Kilo Volts and is harnessed by a thermal, a chemical, a nuclear, an electrical, a radiant, a light, a motion, a sound, an elastic and a gravitational method.

Figure 2:
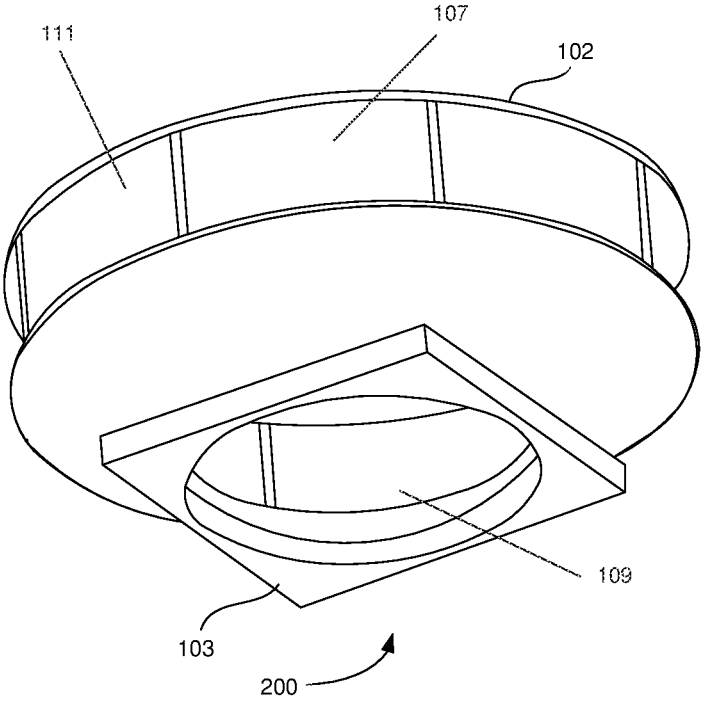
FIG. 2 illustrates a perspective view of an inlet unit of the air purification system of FIG. 1 according to an embodiment herein.

FIG. 2 illustrates a perspective view 200 of an inlet unit of the air purification system of FIG. 1 according to the embodiment herein. The inlet unit 102 serves as an entry for the polluted air and guides the air to flow into the air purification device.

Figure 3:
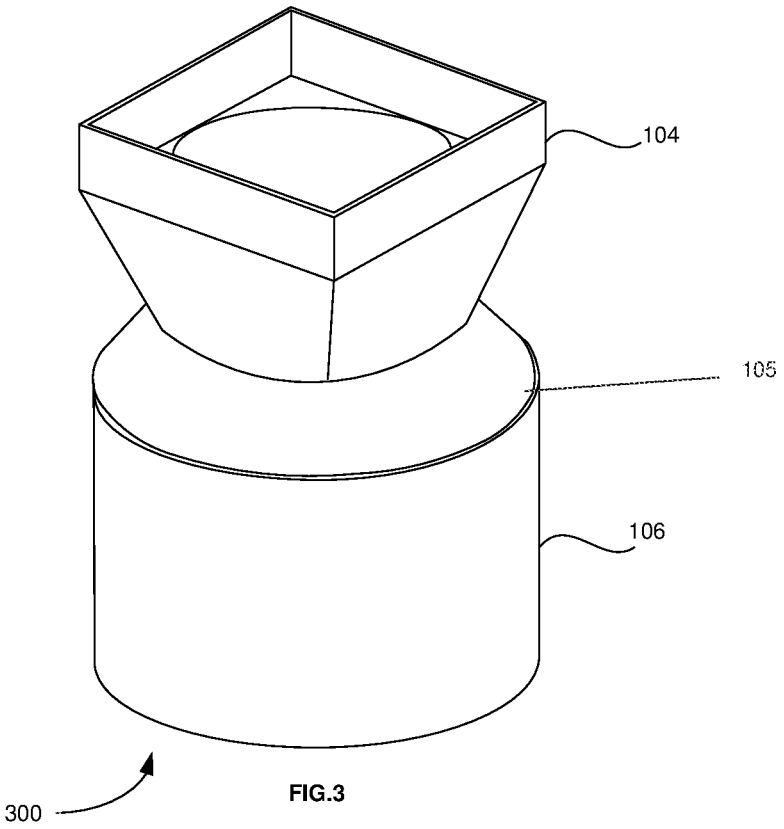
FIG. 3 illustrates a perspective view of a fan holder of the air purification system of FIG. 1 according to an embodiment herein.

FIG. 3 illustrates a perspective view 300 of a fan holder 104 of the air purification system of FIG. 1. The fan holder 104 houses the fan at the front end of the duct attachment. The fan serves the purpose of drawing in the polluted air from the atmosphere. The duct attachment is designed so that its cross-sectional area expands going at least a partial distance downstream along the duct attachment 105 so as to reduce the velocity of the polluted air that passes from the inlet 107 into the ionization chamber 106.

Figure 4A:
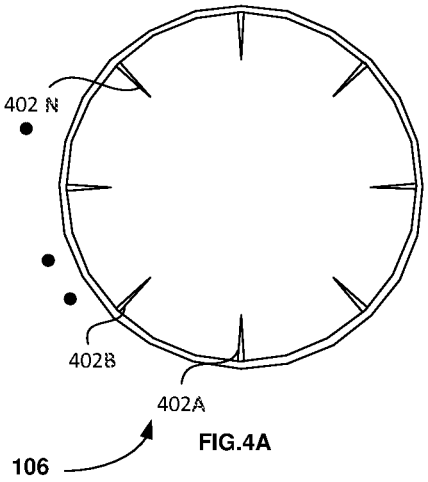
FIGS. 4A-B illustrate exemplary perspective views and FIGS. 4C-D illustrate cross-sectional views of an ionization chamber of the air purification system of FIG. 1 according to an embodiment herein.
Figure 4B:
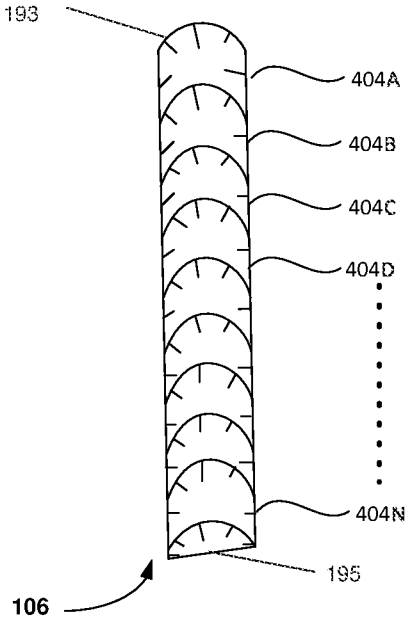
Figure 4C:
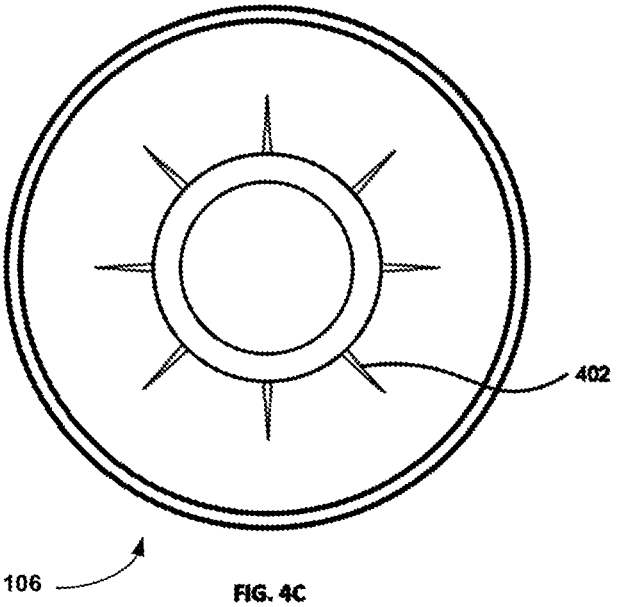
Figure 4D:
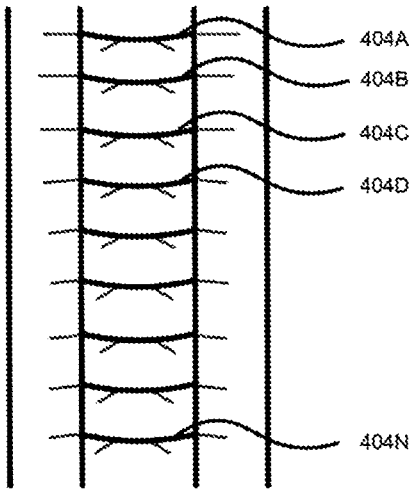

FIGS. 4A-B illustrate exemplary perspective views and FIGS. 4C-D illustrate cross-sectional views of an ionization chamber 106 of the air purification system of FIG. 1 according to the embodiment herein. A plurality of point ionizers 402A-N is arranged to achieve modularity so that the height of the ionization chamber 106 may vary based on a plurality of modular rings 404A-N used. In the embodiment, the plurality of modular rings 404A-N includes the plurality of point ionizers 402A-N on the inner surface of the ionization chamber 106. The height of the ionization chamber 106 may vary based on the required number of modular rings 404A-N. The first modular ring 404A is stacked on the second modular ring 404B and so on to form an array of modular rings 404A-N. The low velocity polluted air passes into the ionization chamber 106. In the embodiment, the ionization chamber 106 may have a tubular body. A high voltage is provided to the plurality of point ionizers 402A-N to produce both positive and negative ions. The oppositely charged ions which cling to air particles cause them to fuse together, leading to coagulation.

Figure 5A:
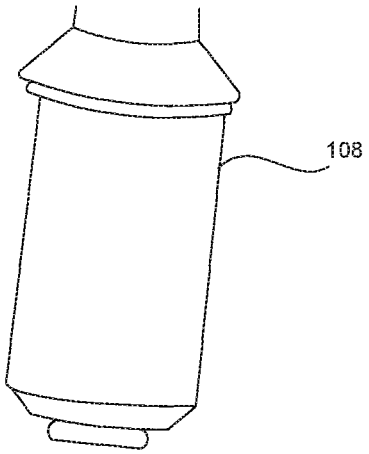
FIGS. 5A and 5B illustrate a perspective view and a cross-sectional view of an output unit of the air purification system of FIG. 1 according to an embodiment herein.
Figure 5B:
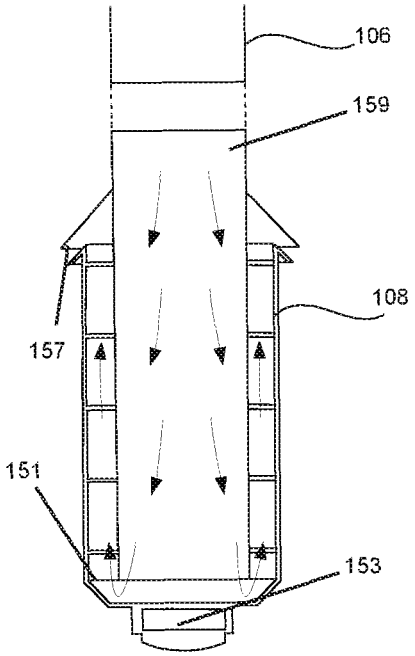

FIGS. 5A and 5B illustrate a perspective view and a cross-sectional view of the outlet unit 108 of the air purification system of FIG. 1 according to the embodiment herein. The purified air from the ionization chamber 106 moves out to the surroundings from the output unit 108 as illustrated using the directional flow arrows. The output unit 108 is designed such that the ionized air is forced to flow down to the bottom of the ionization chamber 106.

Figure 6:
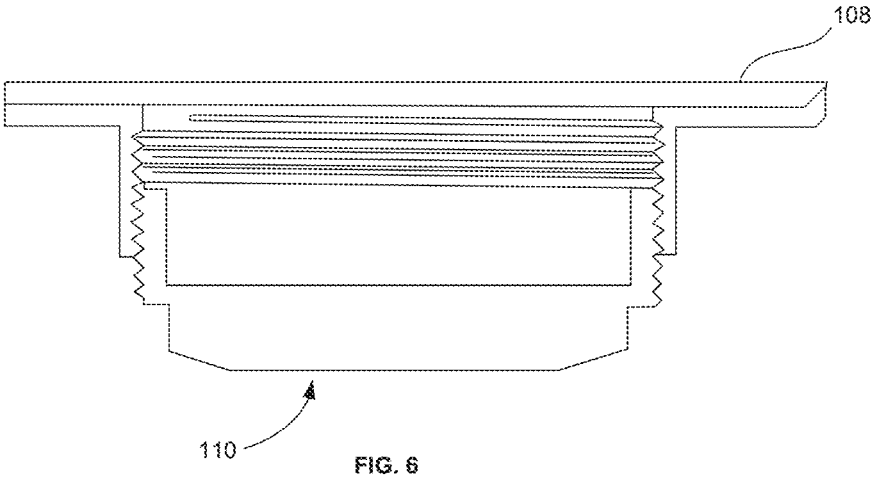
FIG. 6 illustrates a perspective view of a collection chamber of FIG. 1 according to an embodiment herein.

FIG. 6 illustrates a perspective view of a collection unit 110 of FIG. 1 according to the embodiment herein. The collection unit 110 collects dust and other clumped particles from the ionized air. The clumped particles fall to the collection unit 110 due to their increased weight caused by particle fusion. The collection unit 110 is a detachable element of the air purification system 100. In some embodiments, the collected dust may be removed through the output unit 108 at specific intervals depending on the accumulated residue in the collection chamber. A cleaned element can then be attached back to the ionization chamber 106.

Figure 7A:
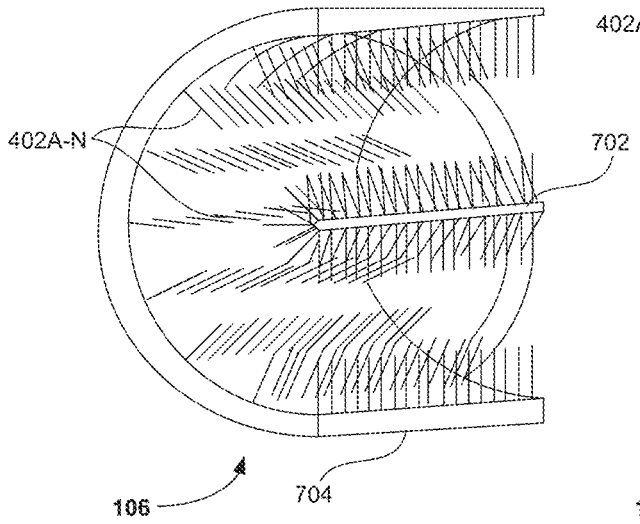
FIGS. 7A and 7B illustrate a perspective view of the ionization chamber of FIG. 1 alternatively implemented to purify the air using an ionization process according to an embodiment herein.
Figure 7B:
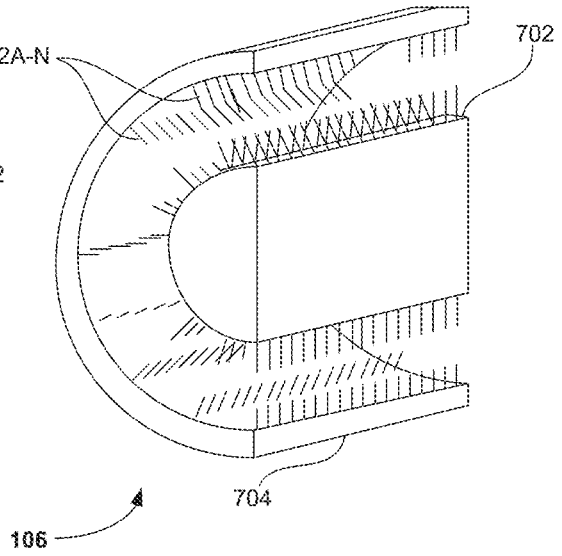
Figures 8A, 8B, 8C:
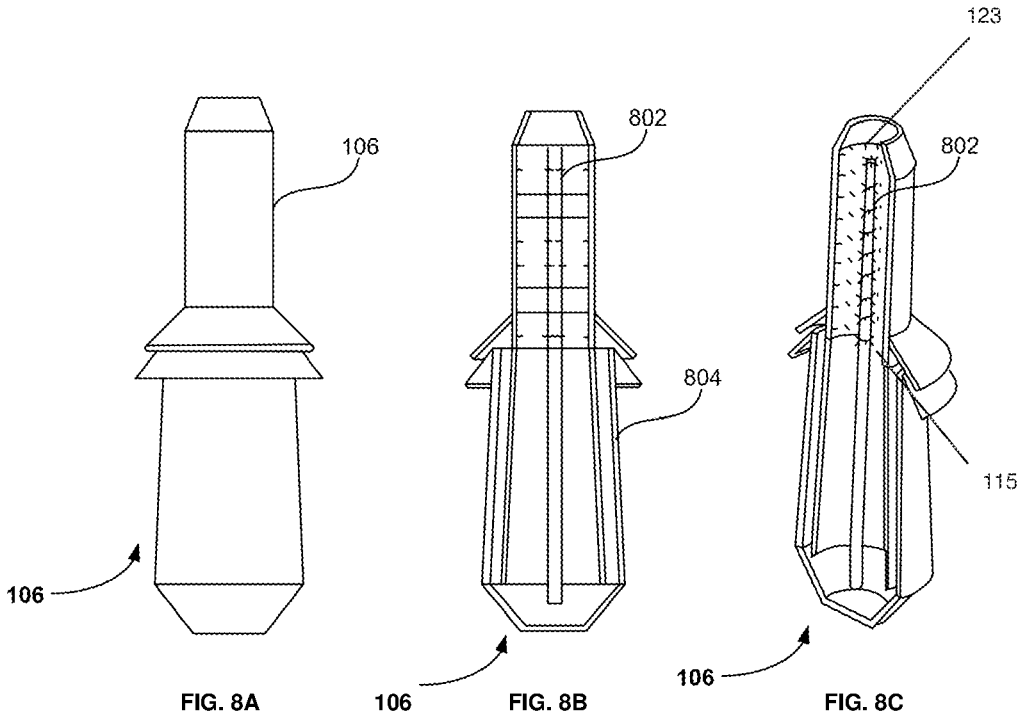
FIG. 8A illustrate a perspective view and FIGS. 8B and 8C illustrate cross-sectional views of the ionization chamber of FIG. 1 to purify the air using an ionization process according to an embodiment herein.
Figure 9:
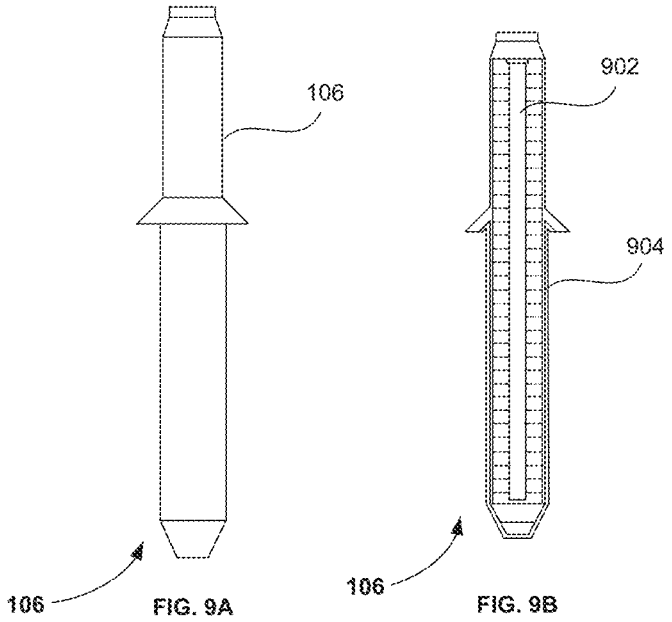
FIG. 9A and FIG. 9B illustrate a front view and a cross-sectional view of the ionization chamber of FIG. 1 alternatively implemented to purify the air using an ionization process according to an embodiment herein.

FIGS. 7A and 7B illustrate perspective views of the ionization chamber 106 of FIG. 1 alternatively implemented to purify the air using an ionization process according to the embodiment herein. The inner core 2, labelled as 702 is housed within the ionization core 1, labelled as 704. In an embodiment, both, the core 1 and core 2 of the ionization chamber 106 include the plurality of point ionizers 402A-N. In the embodiment, the ionization core 1 and 2 may have a frustum, prism, pyramid, sphere, or tube shaped body as shown in FIGS. 8A-C and FIGS. 9A-B respectively. The plurality of point ionizers 402A-N is oppositely polarized so as to generate an electric field. The orientation of the plurality 5 of point ionizers 402A-N may position at any angle between 0 and 180 degrees. In some embodiments, the ionization chamber 106 that is attached to the inlet unit 102 may include a straight ionization core 802. In some embodiments, the straight ionization core 802 may include a diverging design 804 towards the output unit 108. In some embodiments, the ionization chamber 106 includes a laminar body having the plurality of point ionizers 402A-N on inner core 902. The ionization chamber 106 may include the plurality of point ionizers 402A-N arranged on the inner core 902 and an outer core surface 904 along the complete length of the air purification system 100.

In another embodiment, carbon brushes are used instead of needle arrangement. The carbon brushes may be positioned at any angle between 0 and 180 degrees.

Figure 10:
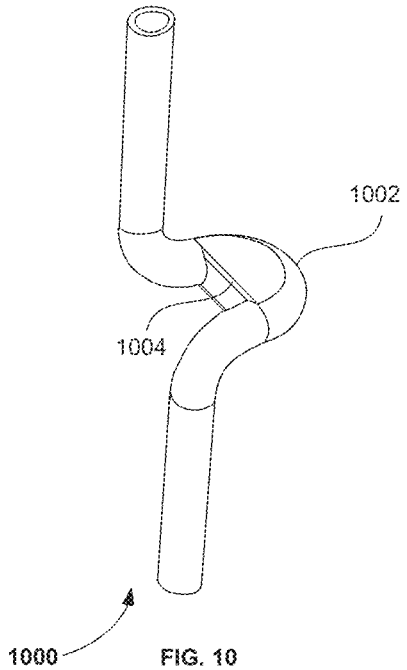
FIG. 10 illustrates a perspective view of an S-Shaped ionization chamber with a horizontal particle collection chamber according to an embodiment herein.

FIG. 10 illustrates a perspective view 1000 of an S-Shaped ionization chamber 1002 according to an embodiment herein. The S-Shaped ionization chamber 1002 includes the plurality of needles/ionizers 402A-N to ionize the particles of the atmospheric air. The S-Shaped ionization chamber 1002 includes the plurality of point ionizers 402A-N to collect the particles in the polluted atmospheric air. The S-Shaped ionization chamber 1002 is connected with a horizontal particle collection chamber 1004 that collects the clumped particles after the ionization process in the S-Shaped ionization chamber 1002.

Figure 11:
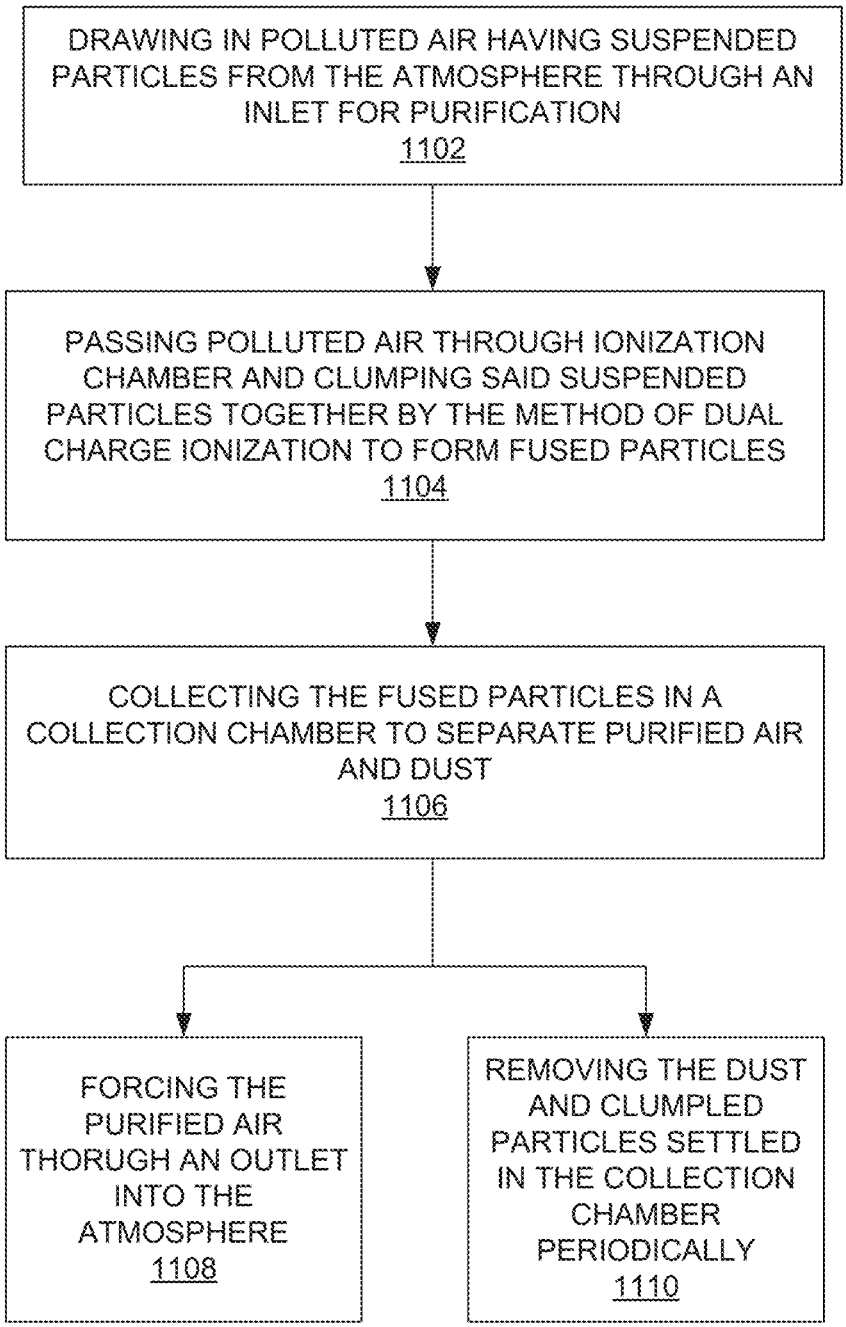
FIG. 11 is a flow diagram illustrating a method for purifying the air using the air purification device of FIG. 1 according to the embodiment herein.

FIG. 11 illustrates the process flow of air purification according an embodiment herein. The air purification process is initiated by the entry of the polluted air into the air purification device. At step 1102, the polluted air is draw into the air purification system 100 from the atmosphere for purification. The air purification system 100 draws the polluted air with suspended particles using the inlet unit 102. At step 1104, the polluted air is passed into the ionization chamber 106 and the suspended particles in the polluted air is clumped together using the dual charge ionization. In some embodiment, when a voltage is applied, the plurality of point ionizers 402A-N captures particulate matter from the polluted air using the positively and negatively charged ions and fuses the positively and negatively charged particles together to form clumped particles. At step 1106, the fused particles are collected in the collection unit 110 to separate purified air and dust. At step 1108, the purified air is forced into the atmosphere using the output unit 108. At step 1110, the dust and the clumped particles are removed from the collection unit 110 periodically. In some embodiments, while the air passes through the ionization chamber, its particles get positively and negatively charged. These charged particles fuse by forces of attraction leading to their accumulation. Then clean air is passed out of the system.

FIGS. 12, 13, 14 and 15 illustrate possible embodiments of an air quality and environmental monitoring system that communicates with air cleaning systems and is enclosed in a protection made up of hydrophobic materials. The hydrophobic material includes but is not limited to nylon. The air quality and monitoring system receives power from a power module including of DC power supply 120, Lithium Ion Battery 128 and charge controller. The DC power supply 120 in this system operates at a voltage of at least 3.3 Volts and the Lithium Ion battery operates at a voltage of at least 0.5 Volts. The sensor array in the system includes gas sensors 125A-D, Particulate Matter (PM) sensors 122, ambient noise sensors 127 and temperature and humidity sensors 126. The gas sensors 125A-D measure the level of Oxides of Nitrogen, Oxides of Sulphur, Oxides of Carbon and Ozone. The PM sensors 122 measure particle size typically in the range of 1.0, 2.5 and 10 micrometers. The Ambient Noise Sensor 127 consists of a piezoelectric microphone which is connected to an operational amplifier. This operational amplifier is connected to an onboard Micro Controller Unit (MCU) which sends out amplitude, frequency, and envelope data to the main microcontroller where this information is processed and presented in the units of Decibels. The Temperature and Humidity sensor 126 includes of separate units of Temperature sensor and Humidity sensor 126. Temperature sensor consists of a thermistor (Temperature varying resistor) which sends an analog signal input to the onboard MCU on the sensor. The humidity sensor also sends analog values to the same MCU onboard the sensor platform such that the analog values change based on the change in conductivity and temperature of the air around it (However, both could be digital sensors instead of analog). The onboard MCU then sends this data to the main system microcontroller as digital values. The Gas sensors 125A-D, PM 5 sensors 122, ambient noise sensors 127 and temperature and humidity sensors 126 communicate information to the microcontroller using analog/digital or transmitter/receiver system. The arrangement of these sensors are examples of the possible embodiments and should not be used to either scale or to misinterpret them for their absolute spatial locations. The micro-controller 124 is an integral 10 part of the air quality and environmental monitoring system and is used for computation and communication purposes. Depending on the extent of capabilities, it includes of a variable number of quantizers, sampler and General-Purpose Input Output (GPIO) pins. Most information from sensors are sent to a microcontroller in the form of time varying electrical signals. Since a continuous signal can be broken into infinite instantaneous values, it would require fundamentally infinite memory on the processor, to interpret this information. Hence in order to be able to compute real time signals, these continuous signals are converted to discrete signals using a SAMPLER. The sampler selects one value out of every 'n' values in a signal, to represent those 'n' values. Once many such single values are computed, the Quantizer reconstructs a new discrete time signal from these sampled values. Hence the quantizer maps a continuous input signal to a reconstructed sampled digital signal. General Purpose Input Output (GPIO) pins are input/output connections on the microcontroller that help sensors, memory storage devices, other peripherals, to interface with the different systems within the microcontroller. The network module 129 includes of a wired or wireless module which is capable of both local and wide-area communications by use of one or more of the following components namely SIM card, Wi-fi, Infrared, Bluetooth or any other wave-based communication system.

Actuators on Outlet or inlet of the air purification system 100 are used to regulate the opening and closing of the output unit 108 and the inlet unit 102 of the system 100. API stands for Application Programming Interface which is a communication protocol between the client (device) and the server (third party server storing weather prediction information) designed to make the software development process for the client (device) easier through the availability of direct Request commands where our devices can call functions on the host server, in order to request real time weather information. Cloud is a network of remote servers hosted on the Internet to store, manage, and process data.

The location module is a part of the theft protection system. It monitors the current location of the system and communicates with the microcontroller 124 via a digital or analog receiver or transmitter system. The digital or analog receiver or transmitter system is a communication system which can send and receive data through wired or wireless methods, using digital or analog signals that are passed through cables/wires or emitted/received through wireless modules and antennas.

The information flow in the air quality and environmental monitoring system is achieved by mutual coordination of its components. The gas sensors 125A-D, PM sensors 122, noise sensors 127 and temperature and humidity sensors 126 send analog/digital signals to the micro-controller 124. The microcontroller also receives input form the DC power supply 120 and the battery management system to communicate with the network module 129. The battery management system receives information from the battery 128 and the charge controller.

The foregoing description of the specific embodiments will reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims.

What is claimed is:

1. An air purification system, comprising:

an inlet unit comprising an inlet unit inlet that draws polluted air, wherein the inlet unit comprises a first end and a second end, wherein the inlet unit comprises:

a cover plate; and a fan holder, wherein the fan holder comprises at least a fan that is rotated at required speed to pull air into the air purification system, a duct attachment, wherein the duct attachment has a cross-sectional area that expands going at least a partial distance downstream along the duct attachment to reduce inlet air speed and a mesh to restrict entry of particulate matter, wherein the cover plate is designed to prevent entry of foreign particles;

an ionization chamber comprising of a plurality of point ionizers operable to produce positively and negatively charged ions for cleaning the polluted air drawn through the inlet unit inlet, wherein the ionization chamber comprises a proximal end and a distal end, wherein the proximal end of the ionization chamber is communicatively coupled to the second end of the inlet unit and the distal end is connected to a collection chamber, wherein when a voltage is applied to the ionization chamber, the plurality of point ionizers produces positively and negatively charged ions that capture particulate matter in the polluted air and fuse positively and negatively charged particles together to form clumped particles, wherein the clumped particles are expelled into the collection chamber;

a collection unit comprising the collection chamber that collects the clumped particles, wherein the collection chamber comprises a collection chamber inlet and a collection chamber outlet, wherein the collection chamber inlet is connected to the distal end of the ionization chamber for collecting the clumped particles; and an output unit comprising an output unit outlet that expels cleaned air, wherein one end of the output unit is connected to the collection chamber outlet.

2. The air purification system of claim 1, wherein the air purification system is communicatively connected to a theft protection module for providing protection to the air purification system, wherein the theft protection module comprises:

a power module that supplies electrical power to a micro-controller, a location module that measures a physical location of the air purification system, a network module that transmits and receives information from a cloud server; and the micro-controller is connected to the location module and the network module via at least one of an analog or digital data receiver.

3. The air purification system of claim 1, wherein the air purification system is communicatively connected to an air quality and environmental monitoring system, wherein the air quality and environmental monitoring system comprises a sensor array comprising at least one of:

a gas sensor that measures a level of Oxides of Nitrogen, Oxides of Sulphur, Oxides of Carbon and Ozone present in the polluted air;

a particulate matter (PM) sensor that measures a size, in a range of 1.0 to 10 micrometers, of a particle present in the polluted air;

an ambient noise sensor that measures an amplitude, frequency of a noise associated with the polluted air; and a temperature and humidity sensor that measures temperature and humidity of the polluted air; and a micro-controller that is communicatively connected to the sensor array, wherein the micro-controller receives sensor information from the sensor array using a digital or analog signal receiver, and process the sensor information to control a speed of the fan or a state of the air purification system and at least one actuator on the output unit outlet or the inlet unit inlet of the air purification system.

4. The air purification system of claim 3, wherein the air quality and environmental monitoring system allows dynamic information flow between the sensor array, wherein the air quality and environmental monitoring system comprises:

a power module controlled by the micro-controller; and a network module connected to the micro-controller via a digital or analog data receiver.

5. The air purification system of claim 4, wherein the power module comprises a DC power supply and a battery module, wherein the DC power supply is connected to the battery module, wherein the battery module comprises a charge controller and a lithium ion battery, wherein the charge controller reads a battery level from the lithium ion battery.

6. The air purification system of claim 4, wherein the second micro-controller receives analog input, digital input, ADC/DAC and is connected to the sensor array and the power module.

7. The air purification system of claim 3, wherein the gas sensor comprises Oxides of Sulphur, Oxides of Nitrogen, Oxides of Carbon, and Ozone sensors, wherein the particulate matter sensor comprises PM1.0, PM2.5 and PM10 sensors.

8. The air purification system of claim 4, wherein the network module contains a wired or a wireless module, wherein the wireless module is capable of local and wide area communications.

9. The air purification system of claim 4, wherein the dynamic information flow comprises of information flow between the sensor array, the micro-controller, the network module, the power supply, the fan of the air purification system, the actuator on the outlet or inlet of the air purification system, an automatic maintenance scheduling system, API's, online third party API's and an online database, wherein the sensor array sends information to the micro-controller, the micro-controller communicates with the cloud server through the network module, wherein the cloud server sends information to the API's and the automatic maintenance scheduling system and stores information in the online database, wherein the API's receive information from the online database, the online third party API's that send information to the online database, wherein the cloud server receives information from the online third party API's and communicates with the network module to send information to the micro-controller, wherein the micro-controller regulates (i) the amplitude of a DC power supply from a battery of the air purification system, (ii) the speed or state of the fan of the air purification system, and (iii) the actuator on the outlet or inlet of the air purification system.

10. The air purification system of claim 2, wherein the theft protection module comprises a protection enclosure that is composed of hydrophobic material.

11. The air purification system of claim 2, wherein the theft protection module is enabled when a DC power supply of the power module is switched off, wherein the power module comprises a battery that supplies power to the microcontroller, a charge controller that sends information on change in battery level as a data input to the micro-controller, wherein the micro-controller sends information on a new location measured by the location module to the cloud server.

12. The air purification system of claim 11, wherein the theft protection module is enabled when a current location is measured by the location module, wherein the location module sends the current location to the micro-controller and the micro-controller sends information on the current location to the cloud server.

13. The air purification system of claim 1 further comprising:

an electrical power supply, wherein the ionization chamber comprises an ionization core, wherein the ionization core has the plurality of point ionizers, wherein the plurality of point ionizers is arranged on an inner surface or an outer surface or both surfaces of the ionization chamber to form a plurality of modular assemblies, wherein the electrical power supply is in operative connection with the plurality of point ionizers, wherein the electrical power supply is operative to supply a pulsed DC voltage to the plurality of point ionizers to cause at least two of the plurality of point ionizers to produce positively and negatively charged ions that are configured to capture particulate matter of the polluted air and fuse them together to form clumped particles, wherein the plurality of point ionizers is positioned at required angles such that tips of any two point ionizers have a distance of at least 0.5 cm.

14. The air purification system of claim 13, wherein the ionization core is shaped in the form of a cylinder, frustum, prism, pyramid, sphere, or S with a length based on the plurality of point ionizers.

15. The air purification system of claim 13, wherein each modular assembly is shaped in the form of a cylinder, frustum, prism, pyramid, sphere, or S with a length based on the plurality of point ionizers.

16. The air purification system of claim 13, wherein an ionization chamber inlet of the ionization chamber is at a first modular assembly and an ionization chamber outlet of the ionization chamber is at an end of a Nth modular assembly.

17. The air purification system of claim 1, wherein the output unit outlet is located upwardly from the collection unit, wherein the output unit surrounds the collection chamber.

18. The air purification system of claim 1, wherein the collection unit is detachable and removably attached through the output unit.

19. An air purification system, comprising:

an inlet unit, wherein the inlet unit comprises a cover plate and a fan holder, a duct attachment, wherein the duct attachment has a cross-sectional area that expands going at least a partial distance downstream along the duct attachment to reduce inlet air speed, wherein the cover plate is designed to prevent entry of foreign particles;

an ionization chamber comprising of a plurality of point ionizers operable to produce positively and negatively charged ions for cleaning polluted air drawn through the inlet unit, wherein the ionization chamber is communicatively coupled between the inlet unit and a collection chamber, wherein when a voltage is applied to the ionization chamber, the plurality of point ionizers produces positively and negatively charged ions that capture particulate matter in the polluted air and fuse positively and negatively charged particles together to form clumped particles, wherein the clumped particles are expelled into the collection chamber;

a collection unit comprising the collection chamber that collects the clumped particles; and an output unit that expels cleaned air, wherein the output unit is connected to the collection chamber unit.

* * * * *